United States Patent [19]

Hartwell

[11] Patent Number: 4,650,201

[45] Date of Patent: Mar. 17, 1987

[54] LIGHTWEIGHT WHEELCHAIR

[75] Inventor: Gregory W. Hartwell, Santa Rosa, Calif.

[73] Assignee: Peterson, Wicks, Nemer & Kamrath, P.A., Minneapolis, Minn.

[21] Appl. No.: 788,500

[22] Filed: Oct. 17, 1985

Related U.S. Application Data

[63] Continuation-in-part of Ser. No. 663,562, Oct. 22, 1984.

[51] Int. Cl.[4] ..... A61G 5/02

[52] U.S. Cl. ..... 280/242 WC; 280/647; 297/DIG. 4

[58] Field of Search ..... 280/242 WR, 647, 650, 280/289 WC, 657, 47.38, 281 LP; 297/DIG. 4; D12/131

[56] References Cited

U.S. PATENT DOCUMENTS

| | | | |
|---|---|---|---|
| 2,713,891 | 7/1955 | Linquist | 155/152 |
| 3,708,182 | 1/1973 | Markiel | 280/289 WC |
| 3,847,440 | 11/1974 | Mattsson | 297/DIG. 4 |
| 3,887,228 | 6/1975 | Ingerson | 280/242 WC |
| 3,893,708 | 7/1975 | Moroney | 297/DIG. 4 |
| 4,360,213 | 11/1982 | Rudwick | 280/242 WC |
| 4,405,142 | 9/1983 | Whetstine | 280/242 WC |
| 4,462,604 | 7/1984 | Meyer | 280/242 WC |
| 4,477,098 | 10/1984 | Minneboaher | 280/242 WC |

*Primary Examiner*—John J. Love
*Assistant Examiner*—Donn McGiehan
*Attorney, Agent, or Firm*—Peterson, Wicks, Nemer & Kamrath

[57] ABSTRACT

A lightweight wheelchair is provided which includes a frame formed of a plurality of elongated members. The frame includes vertical polygon sides which have a generally triangular configuration. The wheelchair seat is supported above a pair of elongated axle support members which join to the rest of the frame at points near the front and back of the frame. An axle extends between the axle support members and is attached at a medial point on each axle support member. The configuration allows for flexing of the axle support members in response to shocks. The frame effectively handles loads and shocks with a minimum of structural mass.

12 Claims, 8 Drawing Figures

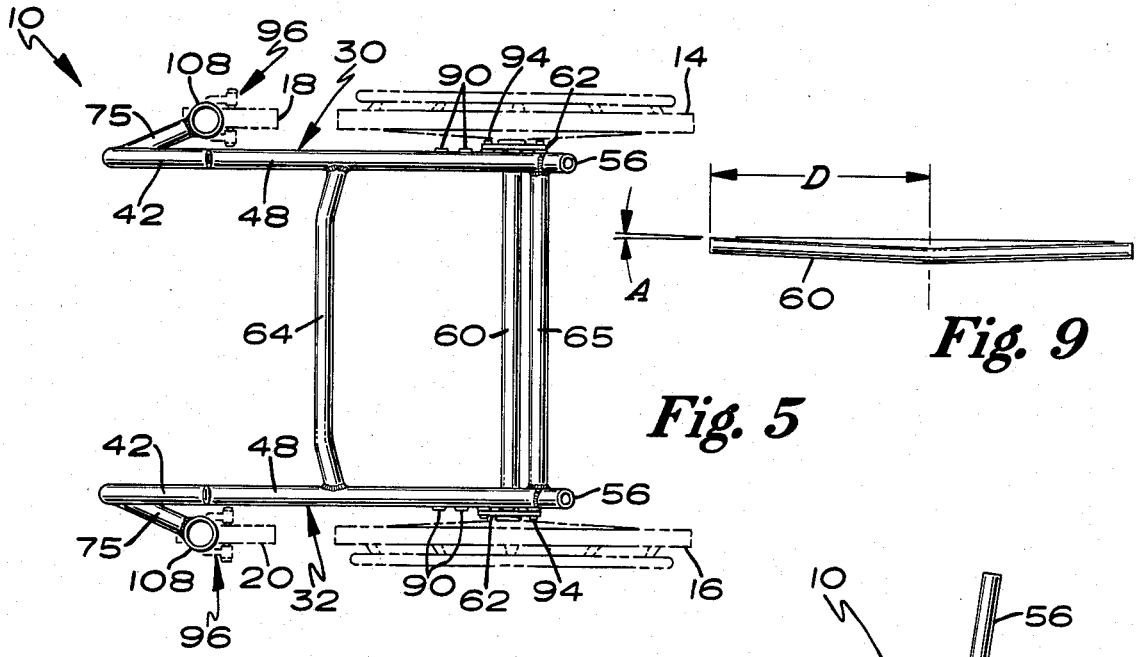
Fig. 9
Fig. 5
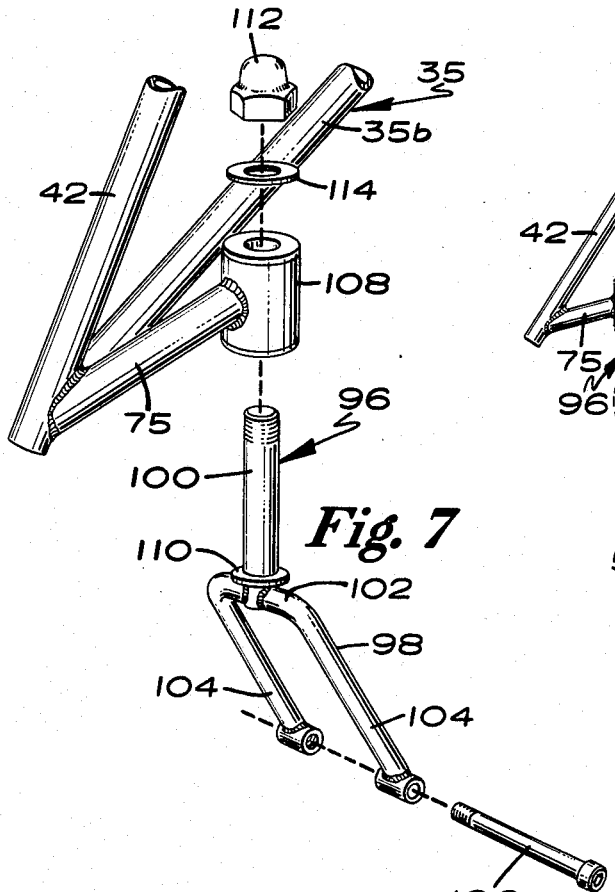
Fig. 7
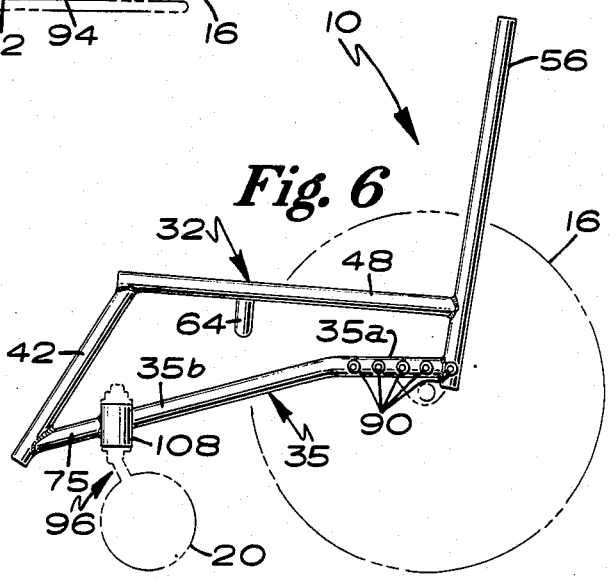
Fig. 6
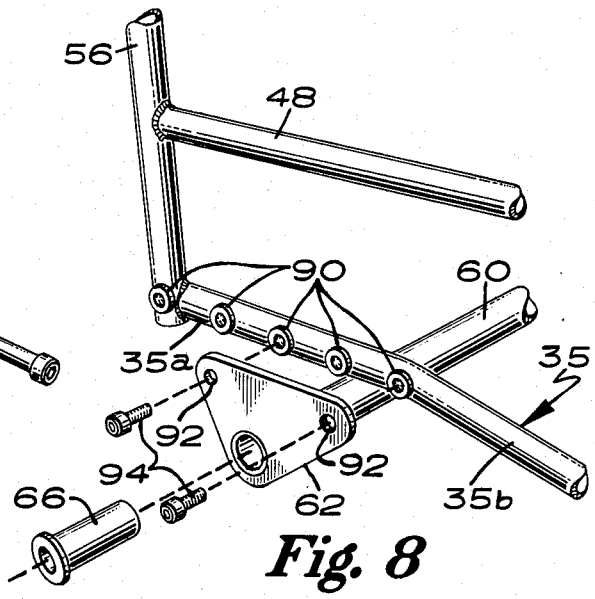
Fig. 8

LIGHTWEIGHT WHEELCHAIR

This is a continuation-in-part of application Ser. No. 663,562, filed Oct. 22, 1984.

BACKGROUND

The invention relates generally to wheelchairs of the type used for self-locomotion and more particularly to an improved wheelchair frame structure which is both resilient and lightweight.

The various needs and requirements of wheelchair users have resulted in a variety of styles and types of wheelchairs. The need for portability has led to numerous types of folding or collapsible wheelchairs, for example. Institutional chairs are usually heavily constructed and have wheel placements which inhibit overturning. "Sports" wheelchairs for racing, basketball and other events are designed for lightness, impact resistance, agility or other specific qualities related to their use.

Despite the variety of wheelchair designs and types, it is possible to generally categorize certain principals of prior art wheelchair construction. Wheel placement largely determines stability, for example. Virtually all wheelchairs have been designed with the large rear drive wheels placed near the back of the chair, well behind the center of gravity, to inhibit a backward rollover by the occupant. Frames are constructed with vertical struts to transmit weight from the seat to the wheel axles. If weight is to be saved, it is usually accomplished by using lightweight metals such as aluminum. Impact resistance is achieved by reinforcement of the frame. Finally, most prior art chairs have numerous adjustments which permit the wheels and other parts to be selectively shifted relative to the frame.

Following these principals of wheelchair design, it has not heretofore been possible to arrive at a satisfactory combination of lightness, resilience, and portability together with superior agility. The problem is that factors which promote one desirable feature can and generally do inhibit others. Ultralight metals usually have less strength, for example, and require additional struts and other structural reinforcement, thus adding to weight and complexity. Struts, or vertical members, also transmit shock from the wheels to the seat and other parts, reducing comfort and creating the need for additional reinforcement. Heretofore, making a wheelchair collapsible adds considerable weight which is inconvenient for handling and transport. Similarly, provision for wheel and other adjustments added weight. The positioning of the drive wheels for maximum stability tended to inhibit agility, making it difficult or impossible for a user to climb curbs or otherwise maneuver the wheelchair.

There is consequently a need in the wheelchair industry for an improved wheelchair. In particular, there is a need for a wheelchair which combines agility, as found in "sports" models, with exceptional lightness. There is also a need for a wheelchair in which strength and resilience are present in a frame having a minimum number of structural members. There is also a need for a wheelchair which is both conveniently portable and adaptable to specific user needs without a large amount of weight-adding hardware.

SUMMARY

Accordingly, a wheelchair is provided of the type having a frame structure for supporting a seat and a plurality of wheels for movement. The front, sides and back of the wheelchair, as set forth below, correspond to the orientation of an occupant of the seat. In the wheelchair, the preferred frame structure comprises two frame sides formed of a plurality of elongated frame members joined together at a plurality of frame joints. Each frame side includes an elongated axle support member extending between a first frame joint near the back of the frame structure and a second frame joint near the front of the frame structure. The two frame sides are joined together by means including an axle member extending laterally between the frame sides. The axle member supports drive wheels for the wheelchair and is attached to the axle support members at a location which is between the first and second frame joints. Such construction permits the axle support members to flex between the first and second frame joints in response to shocks which occur between the axle member and the rest of the frame structure. As a result, such shocks can be readily withstood with a minimum of structural mass.

In its preferred form, the invention further includes additional side frame members having a generally triangular configuration which transfer the weight of the chair user efficiently to the ends of the axle support member. Front caster wheel supports which efficiently handle frontal impact are also provided.

BRIEF DESCRIPTION OF THE DRAWINGS

FIG. 5 is a top plan view of an alternate embodiment of a wheelchair in accordance with the present invention, with the footrest being detached.

FIG. 6 is a plan view of one side of the wheelchair shown in FIG. 5.

FIG. 7 is a partial, exploded, perspective view of the wheelchair shown in FIG. 5.

FIG. 8 is a partial, exploded, perspective view of the wheelchair shown in FIG. 5.

FIG. 9 is a rear view of the axle member of the wheelchair shown in FIG. 5.

DETAILED DESCRIPTION OF THE PREFERRED EMBODIMENT

Figure 1:
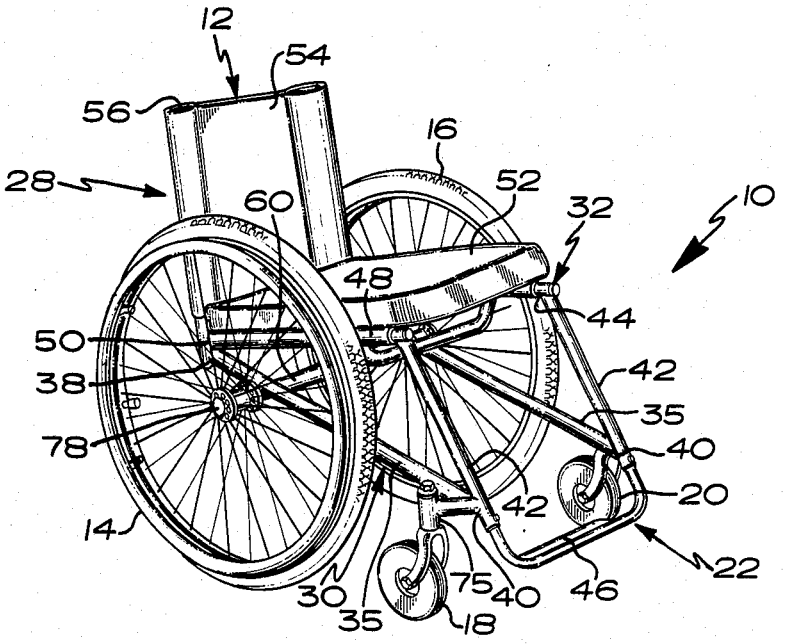
FIG. 1 is a perspective view of a wheelchair in accordance with the present invention.

Referring to FIG. 1, the wheelchair of the present invention includes a frame structure 10 for supporting a seat 12. A plurality of wheels are provided for movement, including two large rear drive wheels 14 and 16 and two small front caster wheels 18 and 20. The drive wheels 14 and 16 are preferably light-weight spoked wheels and the caster wheels 18 and 20 can be of any suitable construction, for example polyurethane. As used in the description below, the orientation and location of the various parts and elements correspond to the orientation of an occupant of seat 12. Accordingly, the front 22, sides 30 and 32, and back 28 of the wheelchair are as shown in FIG. 1. Descriptions of the heights of various parts will be based on the wheelchair resting with the wheels on a horizontal surface.

Figure 2:
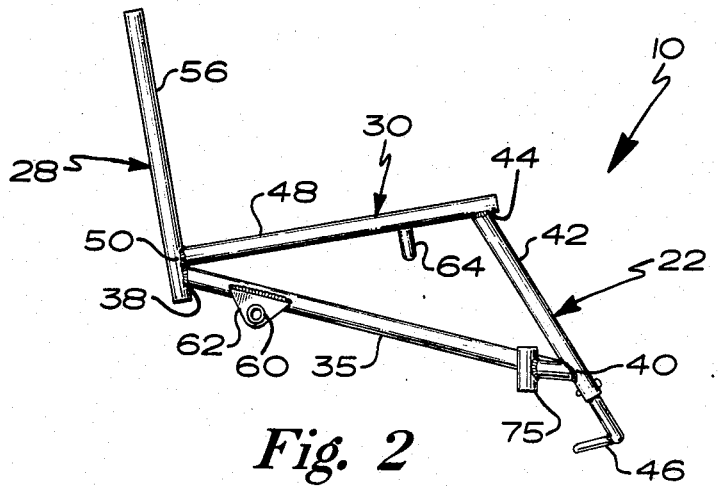
FIG. 2 is a plan view of one side of the wheelchair shown in FIG. 1, showing the frame members only.
Figure 3:
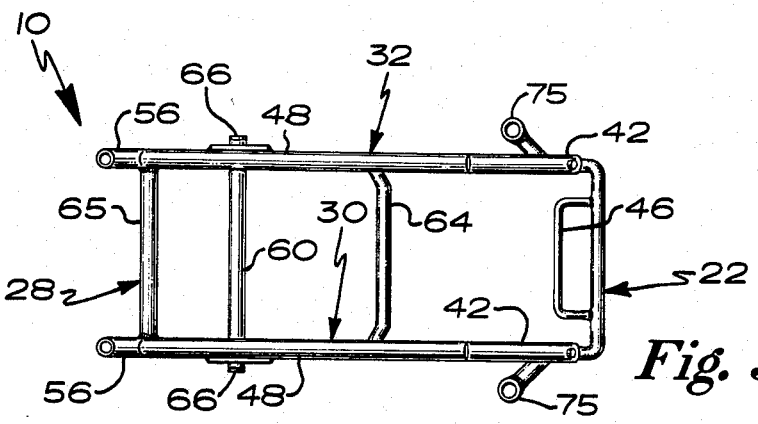
FIG. 3 is a top plan view of the wheelchair shown in FIG. 1, showing the frame members only.

The present invention employs a frame structure illustrated in FIGS. 1, 2 and 3. The frame structure includes two frame sides 30 and 32 joined together by lateral members described more fully below. With reference to FIGS. 1 and 2, frame side 30 will be described in detail, and it should be understood that like parts on frame side 32 will have the same reference numbers in the figures as those on frame side 30.

Each frame side is formed of a plurality of elongated members joined together at frame joints. The elongated members are preferably spring steel tubing, a relatively rigid material which is both strong and lightweight. An example of a suitable steel for this purpose is 4130 Chrome Moly, made by Pacific Tube of Los Angeles, Calif. The frame joints are preferably welded joints. Each frame side is a generally vertical planar polygon having a generally triangular configuration. At the bottom is an axle support member 35 extending between a first frame joint 38 near the back of the frame structure and a second frame joint 40 near the front of the frame structure. Axle support member 35 is a free span between joints 38 and 40, unsupported by other structural members. In particular, no vertical struts are used along the length of member 35 between joints 38 and 40. Member 35 is angled downwardly from back to front with joint 38 disposed higher than joint 40.

A footrest support member 42 extends at a downward angle from a third frame joint 44 to joint 40 to form a second side of frame side 30. Member 42, in addition to forming a structural frame element, also can be used to support a footrest 46 which extends between the frame sides at the front of the wheelchair. Footrest 46 can be either permanently or detachably attached to members 42 and can be of any suitable design. The third side of frame side 30 is seat support member 48, which extends generally horizontally between joint 44 and a fourth frame joint 50, near the back of the frame structure. In its most preferred form, seat support member 48 extends 8° downward from the horizontal from front 22 to back 28 of wheelchair 10. Seat bottom 52 is supported by member 48. Seat 12 also includes a generally vertical seat back 54 supported by a seat back member 56, which extends upward from joints 38 and 50. In its most preferred form, seat back member 56 extends generally perpendicular from seat support member 48 and thus extends 8° outward from the vertical from joint 50 to the free end of seat back member 56. The small length of member 56 between joints 38 and 50, which are closely proximate to one another, forms a short fourth side to complete the polygon shape of frame side 30, which is otherwise generally triangular.

Frame sides 30 and 32 are joined together by means shown most clearly in FIG. 3. An axle member 60 extends laterally between the frame sides and is attached to members 35 at a location which is between joints 38 and 40. Attachment can be by means of a metal plate 62 welded to member 35 and axle member 60. The position of the attachment location for axle member 60 along axle support members 35 is determined by user preference or need, with a more rearward location providing increased stability at a sacrifice in agility. Preferably, the attachment location is beneath seat bottom 52, slightly rearward of the front to rear rotational center of gravity of the wheelchair when occupied. The rotational center of gravity, as used here, would be the point where the entire weight of the chair and occupant is balanced on the rear wheel's axle and the chair will rotate freely around the axle. Having the attachment location slightly rearward of the center of gravity shifts some weight to the front caster wheels but allows the user to easily pivot the chair about axle 60 when desired; for example, to climb a curb.

The position of the attachment location for axle member 60 along axle support members 35 can also be made conveniently adjustable. In a most preferred form, axle support members 35 include a first portion 35*a* interconnected to a second portion 35*b* at an angle slightly less than 180° and in the preferred form at an angle in the range of 163°. First portion 35*a* extends from joint 38 in a generally horizontal manner but is angled slightly from back to front with the end of portion 35*a* secured to joint 38 being disposed higher than the opposite end of portion 35*a*. Second portion 35*b* is angled downwardly from back to front with the end of portion 35*b* interconnected to portion 35*a* being disposed higher than the end of portion 35*b* interconnected to joint 40. In its most preferred form, portion 35*a* of axle support member 35 includes a series of spaced apertures for receipt of internally threaded inserts 90.

In its most preferred form, plate 62 includes spaced apertures 92 at locations corresponding to and complementary to inserts 90 of axle support members 35. Wheelchair 10 further includes bolts 94 for receipt through apertures 92 of plate 62 of axle member 60 and for threadable receipt in inserts 90 of axle support member 35.

It can then be appreciated that the center of balance of wheelchair 10 according to the teachings of the present invention may be adjusted in the field by the location of the attachment of plates 62 to portions 35*a* of support members 35 of frame sides 30 and 32. Specifically, axle member 60 may be moved backward or forward with respect to the center of gravity according to user preference and removably attached to support members 35 by securing plate 62 to portion 35*a* by bolts 94 threadably received into inserts 90.

A second lateral member 64 extends laterally between members 48, beneath the seat. Member 64 is attached to members 48 at a point between joints 44 and 50, preferably about one-third of the way back from joint 44 along member 48. A third transverse member 65 extends laterally between seat back members 56, preferably near the lower ends of members 56, proximate to joints 38 and 50.

Figure 4:
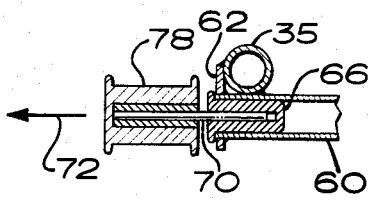
FIG. 4 is an enlarged partial cross-sectional view of a preferred drive wheel mounting means for use on the wheelchair of FIG. 1.

The large rear drive wheels 14 and 16 are preferably detachably attached to axle 60 by means illustrated in FIG. 4. A bushing 66 is provided formed of a suitable bearing material which provides for a lightweight, resilient axle mounting, which will be more free of corrosion, and which insures a smooth slip-fit of the axle assembly such as Nylatron (trademark). According to the preferred form of the present invention, bushing 66 may be inserted in each open end of axle 60 and retained therein by suitable means such as by set screws. Wheel hub 78 has a cooperation stub axle 70 which rides within bushing 66. To remove the wheels, each wheel is pulled laterally sideward in the direction of arrow 72 to pull stub axle 70 from bushing 66 such that the drive wheel and stub axle 70 may be separated from the wheelchair frame structure 10.

In its most preferred form, caster wheels 18 and 20 are mounted by forks 96 generally including a U-shaped portion 98 and a shank portion 100. Shank portion 100 extends from the central portion 102 of U-shaped portion 8 in a direction generally opposite to legs 104 of U-shaped portion 98. In its most preferred form, shank portion 100 extends at an angle in the range of 160°. Axles 106 which rotatably receive caster wheels 18 and 20 extend between and are secured to the free ends of legs 104 of U-shaped portion 98. In its most preferred form, axle 106 is located two inches behind the axis of shank portion 100 to provide the desired amount of trail. Specifically, this spacing of axle 106 from the axis of shank portion 100 reduces the possibility of flutter if the spacing was less, with flutter being more prone for larger diameter caster wheels and also allows for ease of turning which is more difficult if the spacing is greater. Further, this preferred spacing appears to achieve these advantages regardless of the diameter of caster wheels 18 and 20.

To pivotally mount wheels 18 and 20 to frame sides 30 and 32, each frame side also includes a front wheel support extending generally sideward out from the frame. As shown in FIGS. 1–3, front wheel supports 75, are relatively short lengths of frame material extending out from a front wheel support joint which is preferably coincident with frame joint 40. The front wheel supports 75 include a vertically orientated cylindrical portion 108 forming a vertically mounted pivot located on its free end and arranged to rotatably receive shank portion 100 of fork 96. In its most preferred form, shank portion 100 is rotatably secured in cylinderical portion 108 by an abutment 110 secured to shank portion 100 such as be welding, a nut 112 threadably secured to the free end of shank portion 100, and a washer 114 located between cylindrical portion 108 and nut 112. It can then be appreciated that cylinderical portion 108 may include a suitable bearing to reduce the frictional interrelation of portions 100 and 108.

In their most preferred form, supports 75 extend angularly out from joint 40 generally sideward and to the rear. Specifically, in its most preferred form, support 75 is mounted to member 42 at an upward angle which is generally equal to the angle between support 35 and member 42 and preferably is in the range of 42°. Additionally, in its most preferred form, support 75 is mounted to member 42 at an outward angle from support 35 in the range of 25°. The angular mounting for supports 75 provides for improved resistance to frontal impact, as opposed to supports which extend perpendicularly from the frame sides. With a perpendicular mounting, an impact from the front of the wheelchair is transmitted as torque directly to the attaching joint. An angular mounting as shown in FIG. 3 causes a component of a frontal impact to be absorbed by the flexing of support 75 and a component of a frontal impact to be transmitted along the length of member 75. Thus, the stress on joint 40 is reduced requiring a less massive mounting of caster wheels 18 and 20. Furthermore, any impact forces distributed along member 75 are partly distributed along side frame sides 30 or 32. Thus, the forces transmitted into the occupant of wheelchair 10 through seat 12 is diminished according to the teachings of the present invention.

Additionally, the outward angle of support 75 supporting caster wheels 18 and 20 increases the spacing or wheel base of caster wheels 18 and 20. This increased spacing of caster wheels 18 and 20 provides greater stability at the front of the wheelchair 10 to keep wheelchair 10 from tipping when the occupant leans out for example to reach out for a doorknob or to pick up something off the floor.

Further still, with caster wheels 18 and 20 located outward of frame sides 30 and 32, footrest 46 according to the teachings of the present invention may be moved rearward, closer to drive wheels 14 and 16, in a position between caster wheels 18 and 20. It can then be realized that the longitudinal length of wheelchair 10 is reduced also reducing the distance that the feet of the occupant projects forward. Thus, the turning radius of wheelchair 10 is reduced according to the teachings of the present invention resulting in greater maneuverability in tight spaces.

Also, in its most preferred form, support 75 extends outwardly from sides 30 and 32 allowing caster wheels 18 and 20 to be longitudinally in line with drive wheels 14 and 16 in a manner as shown in FIG. 5. This in-line type configuration is advantageous for several reasons. First, the rolling resistance of wheelchair 10 according to the teachings of the present invention on soft ground or other types of soft travel surfaces is reduced since wheels 14, 16, 18 and 20 run in two tracks rather than four as in an out-of-line configuration. Further, wheelchair 10 according to the teachings of the present invention is better able to negotiate narrow rail ramps when necessary because drive wheels 14 and 16 follow the caster wheels 18 and 20. Thus, the in-line configuration of wheels 18 and 20 according to the teachings of the present invention, results in further advantages for wheelchair 10.

The construction of the present invention provides a highly resilient and manueverable, lightweight wheelchair. Its strength and resiliency are believed to result from its novel frame construction which efficiently transmits stress. For example, the triangular configuration of frame sides 30 and 32 according to the teachings of the present invention is believed to be particularly advantageous for several reasons. First, frame sides 30 and 32 are of a very strong construction due to the angular connections of members 35, 42, 48, and 56 as opposed to perpendicular connections of square, rectangular, or box-shaped frame sides. Furthermore, the generally triangular configuration eliminates the bottom half of the frame side. This bottom half in square, rectangular, or box-shaped frame sides may get in the way and is otherwise disadvantageous. Additionally, eliminating the bottom half of the frame side reduces the mass of the frame sides 30 and 32 constructed according to the teachings of the present invention over square, rectangular, or box-shaped frame sides.

Additionally, the generally triangular configuration of frame sides 30 and 32 allow the support member 35 to act in the manner like a leaf spring. Particularly, the weight of an occupant is transmitted from the seat bottom to the rear wheels by way of joints 38 and 40, at opposite ends of axle support member 35. Members 42, 48 and 56 together form a seat support assembly which extends above member 35 between joints 38 and 40. The seat support assembly acts as a yoke which transmits force to what is in effect a stiff spring (member 35). Because axle 60 is attached at a medial point on member 35, member 35 is free to flex between joints 38 and 40 in a leaf-spring effect in response to shocks between the axle and the rest of the frame. Such flexing is believed to be the reason the chair is able to withstand relatively hard use with a minimum of structural mass.

Further, the angular positioning of support member 35 in frame sides 30 and 32 having a triangular configuration also aids in the dissipation of shocks and road jars transmitted to frame sides 30 and 32. Specifically, prior to the present invention, the wheelchair axle was typically mounted on or adjacent to a vertical strut. This resulted in force dissipation by tension or compression in the frame sides. Due to the angularity of support members 35 to which axle member 60 is mounted, dissipation of shocks and road jars also occurs by shear forces in the frame sides, resulting in less forces being transmitted to the seat and to the occupant of wheelchair 10.

Furthermore, due to the strength of sides 30 and 32 and their interconnection by lateral members 64 and 65 and axle member 60, wheelchair 10 according to the teachings of the present invention can withstand the stress of vigorous use without the need for additional struts and supports required in prior wheelchairs and which greatly increased their mass and bulk.

Furthermore, it should be appreciated that due to the leaf-spring effect of member 35, shocks to wheelchair 10 resulting from wheels 14 or 16 engaging a solid object are transmitted to the occupant of wheelchair to a much lessor degree and are partially absorbed by sides 30 and 32. Further, the normal bounces and road jars of wheels 14 or 16 rolling upon a travel surface are similarly absorbed by the leaf-spring effect of member 35. Thus, the comfort level of the occupant of wheelchair 10 according to the teachings of the present invention is greatly enhanced.

Further, the present invention provides an advantageous construction in the ability to provide proper alignment of drive wheels 14 and 16. Alignment problems in wheelchairs produce increased rolling resistance thus increasing the amount of energy expended in propelling the wheelchair and increasing wear of the drive wheels. Wheelchair rear drive wheel alignment includes two critical variables: "Toe In" or "Toe Out", that is, the degree to which the plane of the rear wheel deviates toward or away from the longitudinal axis of the wheelchair measured from the direction of travel; and "Camber", either "positive", or "negative", expressed in degrees, according to how many degrees the plane of the drive wheel deviates from the vertical, measured at the base of the wheel, with positive indicating the base of the wheel closer to the frame than the center of the hub, and negative indicating the base of the wheel farther away from the frame than the center of the hub.

Wheelchair 10 according to the teachings of the present invention include toe and camber alignment designed into the preferred construction where alignment may be preset at the factory. In its most perferred form, axle member 60 includes a slight bend as shown in FIG. 9, with the distance D of the bend being generally equal to one-half of the length of axle member 60. In its most preferred form, the angle A of the bend is in the range of 0 to six degrees, with the 0 degree angle or where axle member 60 is straight and not including a bend being provided for normal uses of wheelchair 10 and angles A in the range of 4 to 6 degrees being provided for preferential uses of wheelchair 10 such as in sports activities and the like where greater stability is desired such as for making faster turns.

Alignment of wheels 14 and 16 may then be factory or otherwise preset according to the teachings of the present invention in the following manner. First, an axle member 60 may be selected including the desired angle A for the type of use to which the wheelchair is to be utilized. It can then be realized that if axle member 60 lies in a vertical plane, and assuming that the center of axle member 60 is located below the ends of axle member 60, angle A corresponds to the number of negative degrees of camber alignment provided to wheels 14 and 16, with the toe alignment being zero. However, by rotating axle member 60 out of the vertical plane, the toe alignment will vary, with rotation of the center of axle member 60 toward the front 22 resulting in a "toe out" condition and with the rotation of the center of axle member 60 toward the rear 28 resulting in a "toe in" condition. It should be realized that rotation of axle member 60 out of the vertical plane reduces the amount of camber alignment. When the desired toe and camber alignment condition is reached by the rotation of axle member 60, plates 62 may then be secured to axle member 60 locking in or presetting the toe and camber alignment. Plates 62 may then be secured to support members 35 by welding such as in the embodiment of FIGS. 1–4 or by bolts 94 such as in the embodiment of FIGS. 5–8 or may have been secured thereto prior to securement of axle member 60 thereto. Wheels 14 and 16 may then be detachably attached to axle member 60 such as in a manner as shown in FIG. 4.

It should be noted that wheelchair 10 of the embodiment of FIGS. 5–9 of the present invention then results in additional advantages in regard to the ability to convert wheelchair 10 for variable uses. Specifically, two or more axle members 60 and plates 62 having different types of wheel alignment may be provided for each frame structure 12. Thus, for example, wheelchair 10 for everyday use having an axle member 60 with 0 degrees camber can be converted for sports use by replacing axle member 60 with another having the desired degree of camber. Specifically, wheels 14 and 16 may be removed by pulling laterally sideward and removing stub axle 70 from bushing 66 of axle member 60. Axle member 60 may then be removed from frame structure 12 by removing bolts 94. An axle member 60 having the desired, pre-set alignment may then be attached in its place and wheels 14 and 16 reattached by placing stub axle 70 in the bushings 66 of the new axle member 60. Thus wheelchair 10 with the new axle member 60 will have greater stability and like features desired for sports use. Wheelchair 10 may then be converted back for everyday use by replacing the axle member 60 or may be converted to have other preset factory drive wheel alignments by substituting other axle members 60.

It can be appreciated that adjusting the center of balance by moving axle member 60 along portion **35*a* of support member 35 will not cause misalignment of drive wheels 14 and 16 due to the fixed securement of plates 62 to axle member 60 resulting in a factory preset alignment condition. Furthermore, it should be appreciated that the size of plates 62 may be varied to change the spacing of axle member 60 from members 35 to compensate for angle A present in axle member 60. Specifically, the greater the angle A of axle member 60, the larger the spacing between axle member 60 and members 35 for the same frame structure 10**.

Furthermore, it should be noted that front casters 18 and 20 may also be replaced for converting wheelchair 10 for variable uses according to the teachings of the present invention. For example, caster wheels 18 and 20 may be of the pneumatic type for everyday use and may be of the solid type for sports use, such as formed of polyurethane. Specifically, shank portion 100 is removed from cylindrical portion 108 such as by loosening and removing nut 112 from shank portion 100. Shank portion 100 may then be removed from cylindrical portion 108 such that a first fork having one type of caster wheel can be replaced by a second fork having another type of caster wheel. The new fork can then be rotatably secured by tightening nut 112 on shank portion 108. Wheelchair 10 may then be converted back or caster wheels replaced to other types by repeating this procedure.

Other advantages of the present invention over prior art wheelchairs include a very low weight. The present invention can be made to weigh under 19 pounds. It, nevertheless, has the strength to withstand use in competitive sports events. Use of a one-piece axle member maximizes the strength of the wheel mounts without the need for heavy plates or the like required for separate wheel mounting systems. It is also believed that the use of steel instead of aluminum saves weight, since steel is stronger, pound for pound. The triangular configuration of the frame sides is also strong and light. Since the chair is well balanced and light, it is also highly agile and manueverable.

It should be noted although wheelchair 10 is not collapsable or foldable as in prior wheelchairs, wheelchair 10 according to the present invention is easier to load and stow in automobiles than prior wheelchairs. Specifically, drive wheels 14 and 16 may be readily removed from the frame structure 10 by pulling laterally sideward on wheels 14 and 16, thus breaking wheelchair 10 into three major components. Therefor, a first major advantage of wheelchair 10 may not be easily appreciated, i.e., the occupant does not neet to lift the total wheelchair 10, but rather lifts three separate components, each having less weight than the total weight of the chair. Thus, although wheelchair 10 is of a very low weight and thus is even easier to lift than prior wheelchairs, it is still easier to lift due to its separation into three major components. Once wheels 14 and 16 are removed from frame structure 10, frame structure 10 may be easily slipped onto the automobile seat and rides there like a child's car seat. This car seat riding ability is the result of the triangular configuration of frame sides 30 and 32 which eliminates the bottom half of the frame sides as would exist in square, rectangular, or box-shaped frame sides of prior wheelchairs. The wheels may be stowed at any convenient location. It should then be realized that wheelchair 10 according to the teachings of the present invention can be stowed in a very small space. Further, it may be appreciated that wheelchair 10 according to the teachings of the present invention is loadable and storable in smaller, compact cars rather than the large automobiles having large interiors and large door openings required by prior foldable or collapsible wheelchairs.

Alternative embodiments are possible within the scope of the present invention. The types of wheels and their mounting system are illustrative, for example, and other types of wheels could be used. Other design considerations which could be adjusted include the height of seat back 54 and the axle location along member 35.

An improved wheelchair has been shown and described. The chair combines agility and lightness, strength and resilience, using a frame with a minimum number of structural members. Because of its lightness and its removable wheels, the chair is highly portable without the need for a large amount of weight-adding hardware.

What is claimed is:

1. A wheelchair having a frame structure for supporting a seat and plurality of drive and front wheels for movement, and in which the front, sides and back thereof correspond to the orientation of an occupant of such seat, the frame structure comprising: two frame sides formed of a plurality of elongated frame members joined together at a plurality of frame joints, each said frame side including an elongated axle support member extending between a first frame joint near the back of the frame structure and a second frame joint near the front of the frame structure, said two frame sides being joined together by means including an axle member extending laterally between said frame sides which support the drive wheels for the wheelchair, said axle member being attached to each said axle support member at a location which is between said first and second frame joints such that said axle support members are free to flex between said first and second frame joints in response to shocks which occur between said axle member and the rest of the frame structure whereby said shocks can be withstood with a minimum of structural mass; and means for adjusting the location of attachment of said axle member to one of a plurality of selected locations along said axle support members.

2. A wheelchair as in claim 1 wherein the adjusting means comprises, in combination: means for detachably attaching the axle member to the axle support members.

3. A wheelchair as in claim 1 wherein the detachably adjusting means comprises, in combination: apertures formed in the axle support member longitudinally spaced from each other; and means for securing the axle member to the axle support members.

4. A wheelchair as in claim 1 in which each said frame side further includes a front wheel support member extending in a generally sideward direction out away from said frame side for supporting a front caster wheel; and wherein the front wheel support member extends at a horizontal, outward angle with respect to the axle support member in the range of 25°.

5. A wheelchair having a frame structure for supporting a seat and plurality of drive and front wheels for movement, and in which the front, sides and back thereof correspond to the orientation of an occupant of such seat, the frame structure comprising: two frame sides formed of a plurality of elongated frame members joined together at a plurality of frame joints, each said frame side including an elongated axle support member extending between a first frame joint near the back of the frame structure and a second frame joint near the front of the frame structure, each said frame side further including a front wheel support member extending in a generally sideward direction out away from said frame side for supporting a front caster wheel; said two frame sides being joined together; in which, when the wheelchair rests on a horizontal surface, said second frame joints are lower than said first frame joints and said axle support members each extend angularly from a low point in the front to a high point in the back of the frame structure; and wherein the front wheel support extends at a vertical angle from the horizontal generally equal to the vertical angle from the horizontal that the axle support member extends from the second frame joint.

6. A wheelchair as in claim 5 further comprising, in combination: caster wheel forks, with the caster wheel forks including a U-shaped portion having legs extends from and on opposite sides of a central portion and a shank portion, with the shank portion extending from the central portion intermediate and in an opposite direction from the legs; a caster wheel axle extending between the legs of the U-shaped portion of the forks for rotatably mounting the caster wheels to the fork, with the caster wheel axle located in the range of two inches behind the axis of the shank portion; and means for rotatably mounting the shank portion of the fork about a generally vertically mounted pivot to the front wheel support.

7. A wheelchair as in claim 6 wherein the shank portion rotatably mounting means comprises, in combination: a generally vertically orientated cylindrical portion mounted to the front wheel support, with the cylindrical portion arranged to rotatably receive the shank portion of the caster wheel fork; and means for rotatably securing the shank portion of the caster wheel fork in the cylindrical portion.

8. A wheelchair as in claim 1 in which each said frame side further includes a front wheel support member extending in a generally sideward direction out away from said frame side for supporting a front caster wheel; and wherein the front wheel support member has a length for supporting the front caster wheels longitudinally in-line with the drive wheels allowing the front caster wheel and the drive wheel adjacent each of the frame sides to run in a single track to reduce rolling resistance in soft ground and to better negotiate narrow rail ramps when necessary.

9. A wheelchair having a frame structure for supporting a seat and plurality of drive and front wheels for movement, and in which the front, sides and back thereof correspond to the orientation of an occupant of such seat, the frame structure comprising: two frame sides, said two frame sides being joined together by means including an axle member extending laterally between said frame sides which support the drive wheels for the wheelchair; and means for presetting the alignment of the drive wheels with respect to the frame sides comprising, in combination: a bend in the axle member such that the ends of the axle member are at an angle with respect to a straight orientation, with the axle member being attached to the side frames to place the drive wheels at an angle to the side frames for presetting the alignment of the drive wheels.

10. A wheelchair having a frame structure for supporting a seat and drive and front wheels for movement, and in which the front, sides and back thereof correspond to the orientation of an occupant of such seat, the frame structure comprising: two frame sides; said two frame sides being joined together by means including a one-piece axle member extending laterally between said frame sides, with the axle member having first and second open ends; bushings having a size and shape for receipt within the open ends of the axle member; means for retaining the bushings in the open ends of the axle member; and stub axles removeably received in the bushings and forming the rotation axes for the drive wheels, with the bushings being adaptable for providing a slip-fit of the stub axles for allowing removal of the drive wheels by pulling the wheels laterally sideward pulling the stub axles from the bushings of the axle member.

11. A wheelchair as in claim 9 in which the axle member is detachably attached to the side frames by plates, with the axle member being secured to the plates at an orientation, and wherein the plates are removably secured to the side frames allowing changing of the wheel alignment in the wheelchair by substituting axle members secured to the side frames.

12. A wheelchair as in claim 1 in which, when the wheelchair rests on a horizontal surface, said second frame joints are lower than said first frame joints and said axle support members each extend angularly from a low point in the front to a high point in the back of the frame structure; in which said frame sides each further include a seat support assembly extending between said first and second frame joints for supporting the wheelchair seat and for carrying the force of weight on the seat to said first and second frame joints; in which each said seat support assembly is formed of a plurality of elongated members joined together including a seat support member extending to the back of the frame structure from a third frame joint and which is generally horizontal and located above said axle support member when the wheelchair is resting on a horizontal surface, and a footrest support member extending angularly downward toward the front of the frame structure from said third frame joint and joining with said axle support member at said second frame joint; and in which the seat support member, the footrest support member and the axle support member of each said frame side are joined together in a substantially triangular configuration, with the seat support member and the footrest support member intersecting at an obtuse angle and with the axle support member and the footrest support member intersecting at an acute angle.

* * * * *